United States Patent [19]

Davis

[11] 4,102,012

[45] Jul. 25, 1978

[54] SLIDING AND SWINGING WINDOW STAYS

[75] Inventor: Ronald Percival Davis, Wellington, New Zealand

[73] Assignee: Interlock Industries Limited, Wellington, New Zealand

[21] Appl. No.: 746,616

[22] Filed: Dec. 1, 1976

[30] Foreign Application Priority Data

Dec. 3, 1975 [NZ] New Zealand ..... 179432
Sep. 23, 1976 [NZ] New Zealand ..... 182146

[51] Int. Cl.[2] ..... E05F 3/22
[52] U.S. Cl. ..... 16/179; 49/248
[58] Field of Search ..... 16/193, 178, 179; 49/248, 250, 251

[56] References Cited

U.S. PATENT DOCUMENTS

| | | | |
|---|---|---|---|
| 2,784,459 | 3/1957 | Anderberg et al. | 49/250 |
| 3,497,909 | 3/1970 | Davis | 16/193 |
| 3,721,044 | 3/1973 | Kvasnes | 49/248 |
| 3,722,142 | 3/1973 | Anderberg et al. | 49/248 |
| 3,838,537 | 10/1974 | Stauenau et al. | 49/248 |

FOREIGN PATENT DOCUMENTS

| | | | |
|---|---|---|---|
| 223,598 | 3/1959 | Australia | 49/251 |
| 664,807 | 6/1963 | Canada | 49/251 |

*Primary Examiner*—Ronald Feldbaum
*Attorney, Agent, or Firm*—Young & Thompson

[57] ABSTRACT

A window stay for adjustable mounting of a window sash on a window frame. The stay comprises a frame mounting plate and a sash mounting plate with long and short arms joining the respective plates to one another. The ends of the longer arm are pivotally joined to the respective plates but the shorter arm is pivoted by one end to the sash plate while the other end is pivoted to a free sliding carriage on the frame plate. Means are provided so that the carriage can be locked in at least one position on the frame plate.

19 Claims, 20 Drawing Figures

A
14
23
15
I
I
16
25
23
14
11
23
12
10
14
23

16
IV
26
23
35
22
21
15
14
23
25
IV
23
11
14
10
12
23
14
23

FIG. 4.
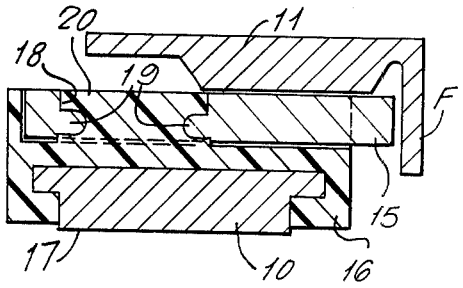
FIG. 3.
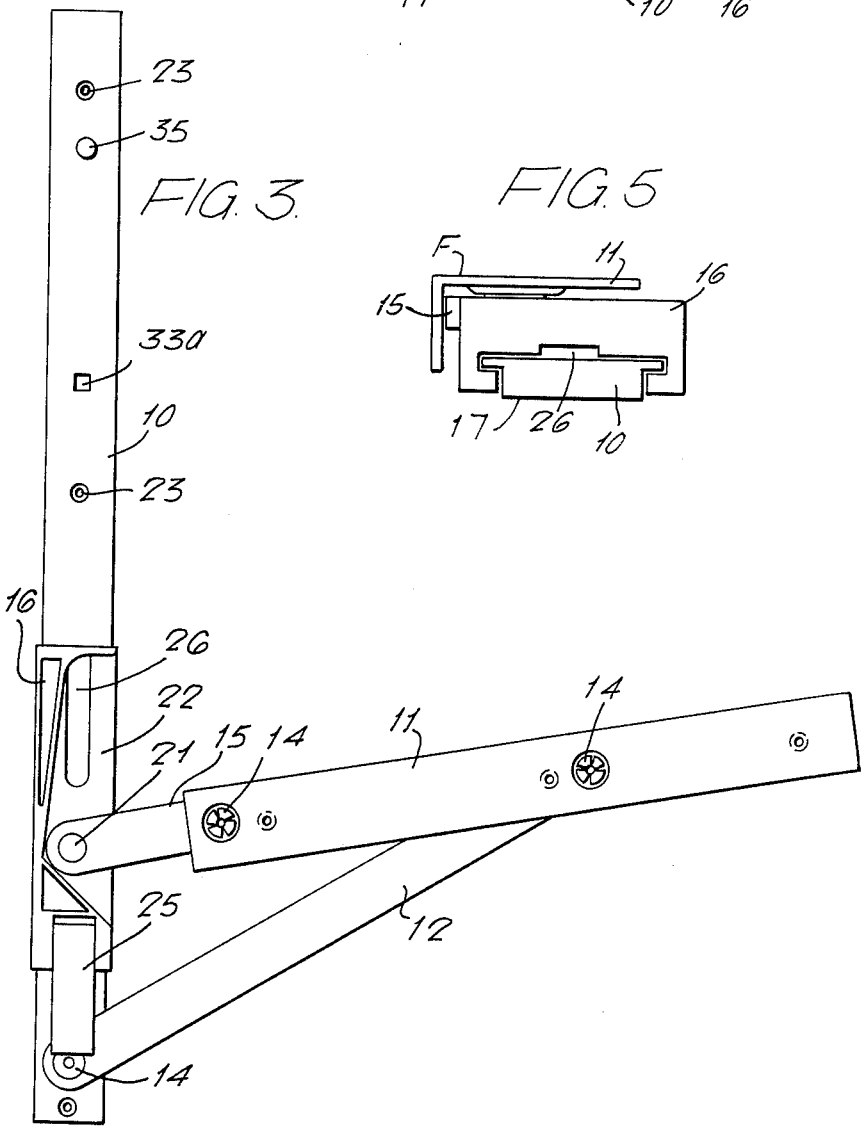
FIG. 5

SLIDING AND SWINGING WINDOW STAYS

BACKGROUND OF THE INVENTION

1. Field of the Invention

This invention relates to improvements in stays designed for use in the adjustable mounting of windows or the like.

2. Prior Art

It is already known to provide a window stay having a window frame mounting plate, two arms of different length each pivoted at one end to the window mounting plate, a window sash mounting plate pivoted to outer ends of the two arms, each pivoted joint being a wear-resistant friction type joint. Such a window stay is described in U.S. Pat. No. 3,497,909.

This type of window stay has been most satisfactory in the mounting of windows with one of the many advantages being that it provides, when open, a clear space between the top of the sash and the window frame so that the window may be cleaned. In addition the friction type joints permit the window to be opened to any one of a number of positions between closed and fully open and firmly retains the window in that position so that the required amount of ventilation can be obtained.

In some countries new standards have or are being enforced which in part are concerned with safety requirements for the cleaning of windows. The requirements limit the distance a window cleaner may be required to reach from inside the building to clean the outside of windows. Additionally some standards are now limiting the force which a person must apply to open so called "frictional restrained" windows. According to these standards the maximum applied force must not exceed 80 Newtons. Still further in some countries window stays must be of a design which permit controlled opening of windows to large degrees of opening so that adequate ventilation can be achieved.

A further type of known window stay comprises a frame mounting plate, a sliding shoe incorporated with the mounting plate, a sash mounting plate pivoted at one end to the shoe and pivotally coupled to the frameplate by an arm. This type of stay suffers from the shoe not having a smooth and non-jamming movement along the frameplate. In addition this type of stay cannot, because of its construction, move the head of the sash directly out and back from the frame for effective weatherproofing and requires a more complicated window construction.

It is an object of the present invention to provide a window stay for adjustable mounting of a window sash on a window frame which is easy to operate, is not prone to jamming and allows the sash to be reversed in relation to the frame for cleaning of the window pane.

SUMMARY OF THE INVENTION

Broadly in one aspect the invention can be said to consist of a window stay for adjustable mounting of a window sash on a window frame comprising a first mounting plate adapted for attachment to the frame of a window, a second mounting plate or plates adapted for attachment to a sash of a window, a carriage freely slidably mounted on the first mounting plate, first and second arms each of which is pivoted at one end to the or a second mounting plate, the first arm being pivoted at its other end to the first mounting plate, the second arm, which is of shorter length than the first arm, being pivoted at its other end to the carriage means to lock said carriage in at least a position where the pivot mount of the second arm to the carriage is at its greatest distance away from the pivot mount of said first arm to said first mounting plate, whereby with the stay in use a sash can be moved from a closed position in a window frame to an open end position and thereupon opened further by releasing the carriage from its said locked position.

BRIEF DESCRIPTION OF THE DRAWINGS

FIG. 3 is an elevation view of the stay in a fully open position, and FIG. 4 is an enlarged cross-section view on line I-I of the stay of FIG. 1, FIG. 5 is an end view in direction of arrow A in FIG. 1.

DETAILED DESCRIPTION OF CERTAIN PREFERRED FORMS OF THE INVENTION

Figures 1, 2:
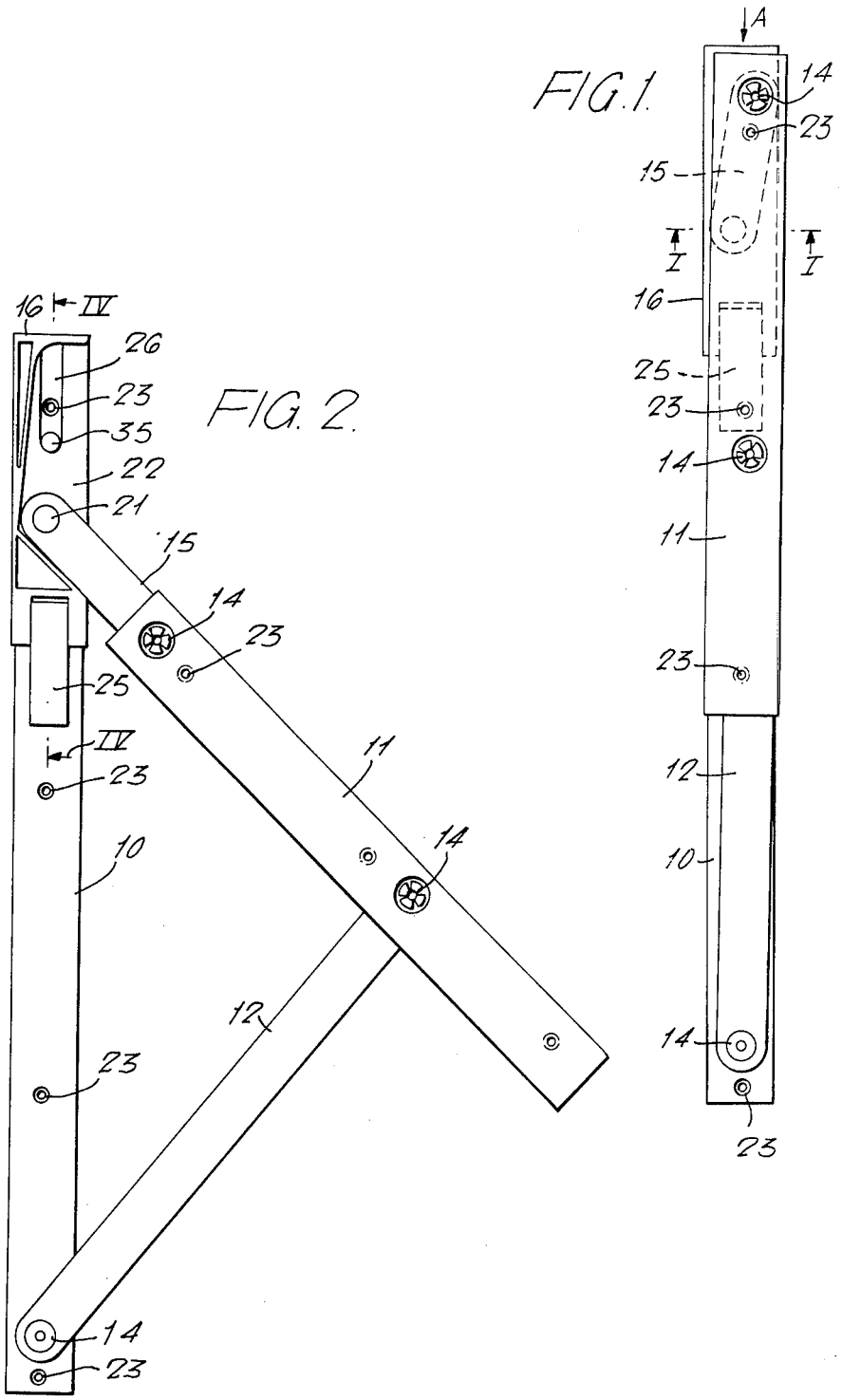
FIG. 1 is an elevation view of a first form of the stay shown in the closed position.
FIG. 2 is an elevation view of the stay of FIG. 1 in an open position.
Figure 6:
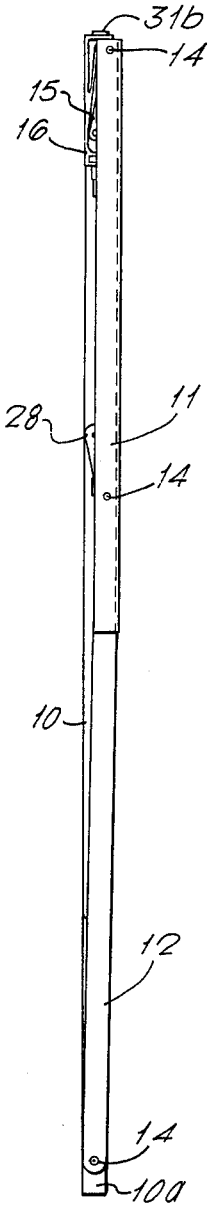
FIG. 6 is an elevation view of a second form of the stay shown in the closed position.

Referring to FIGS. 1 to 3 the first or frame mounting plate is shown at 10 and the second or sash mounting plate at 11. Countersunk openings 23 are provided along the length in each plate 10 and 11 for the reception of fastening rivets, screws, etc. by which said plates can be fastened to the respective frame and sash. The first arm 12 is joined at one end near the lower end of plate 10 and at the other end to the second plate 11 upward from its lower end. The pivot joints 14 are preferably wear-resistant friction joints of the type described in British Patent No. 1,304,830. A friction joint 14 of this type is also provided at the join of the second arm 15 with second plate 11. The first arm 12 is considerably longer than the second arm 15 as can be seen in the drawings. Plate 11 can be in two separate parts with arm 15 pivotally connected to one and arm 12 to the other.

Referring to FIGS. 4 and 5 the frameplate 10 is of shallow T section and the carriage 16 has a longitudinal slot 24 which is of complementary cross-section. As shown in FIGS. 4 and 5 the face 17 of the plate 10 which engages against the frame of the window stands proud of the carriage 16. The second arm 15 is provided with a hole 18 at its carriage mounting end and this hole incorporates an inner peripheral rib 19 (FIG. 4). The carriage 16 is formed from a plastics material and has an upstanding stud 20 which engages in hole 18 and by employing a heat flow process the arm 15 is rotatably secured to the stud 20 by rib 19. This pivot joint 21 between the arm 15 and carriage 16 is thus not a friction joint like joints 14.

The inner end of arm 15 moves within a recessed portion 22 formed in the face of the carriage 16. The recessed portion 22 restricts the arc of operation of the top arm to a minimum of 8°, from the vertical, when the window is closed and to an angle in range of 30° to 50°, below the horizontal, when the window is in the open position shown in FIG. 2, (which for ease of reference is hereinafter referred to as the "first open position"). The former ensures that the stay cannot be incorrectly fitted thereby causing the top arm to "toggle over" at less than the minimum outward angle of 8°, whilst the open angle stop is designed to protect the top front flange F of sash plate 11 from damage by contacting arm 15.

Figure 20:
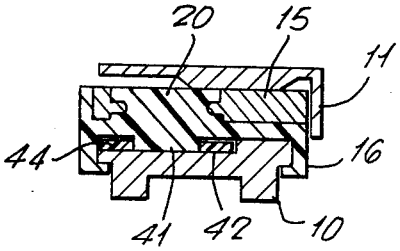
FIG. 20 is an enlarged cross-sectional view through the pivot point of a modified form of the sliding carriage.

The carriage 16 is free moving on the plate 10 when unlocked (as will be hereinafter described) but in heavy duty stays this free movement can be assisted by a series of spaced apart small hard plastics wheels (not shown) mounted on the inner face of frameplate 10. The wheels are mounted on axles remaining after circular recesses are milled in the plate 10. The wheels can be provided down one edge of plate 10 to project therefrom or they can be staggered to project from both side edges and engage with the inner surface(s) of the carriage. Alternatively, and as shown in FIG. 20, a wheel 44 is mounted on a stud 41 which projects downwardly from the underside of carriage 16. The wheel 44 runs in a rebated area 42 in plate 10 as shown in FIG. 20. Stud 41 can be a continuation of stud 20.

Figure 17:
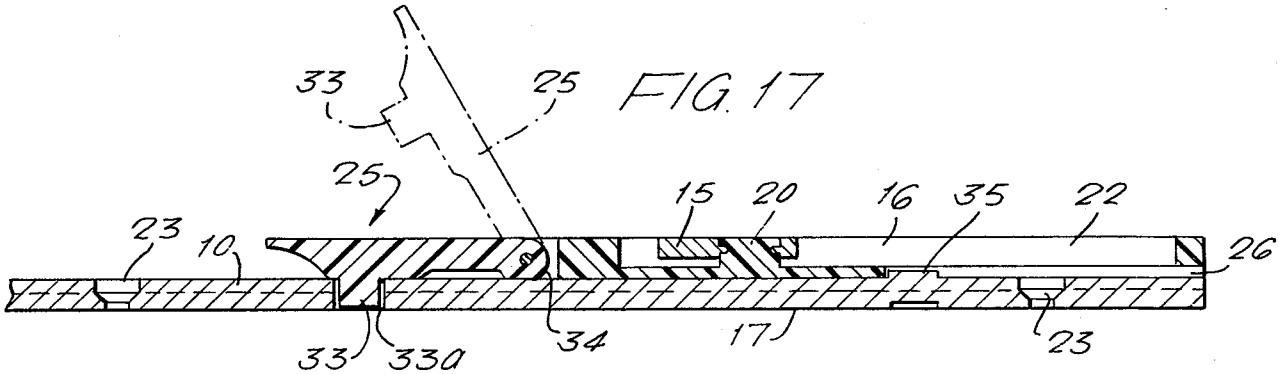
FIG. 17 is an enlarged cross-section view on line IV—IV of FIG. 2.

At the lower end of carriage 16 there is provided a catch 25. The catch 25 is formed with an outwardly projecting pin 33 at its lower end and is hingedly fastened to the carriage 16 at its upper end. The catch 25 is formed with a cam profile 34 at the hinged end which progressively comes into engagement with the surface of the plate 10 as the catch 25 is moved into the locked position shown in FIG. 17. The unlocked position with cam profile 34 disengaged from the surface of plate 10 is shown ghosted in FIG. 17. In the locked position pin 33 engages in opening 33*a*. Upon release of the pin 33 from hole 33*a* and sufficient movement of the catch 25 to disengage the cam brake 34 the carriage 16 can be freely slid up or down the plate 10. In FIG. 3 the carriage 16 is in the fully lowered position hereinafter referred to as the "second open position" and a sash opening of around 125° can be obtained. Intermediate lock positions between the first and second positions can be achieved by lowering the catch 25 so the cam profile 34 engages the plate surface and so retains the carriage 16 in position. Alternatively, a series of spaced apart openings (the same as opening 33*a* but not shown) can be provided along the length of plate 10.

The openings 23 at the top and bottom ends of the frame plate 10 can be elongate to provide for adjustment of the fit of the sash before the final fixing screws are fitted. A slot 26 (see FIG. 5) is formed in the underside of the sliding carriage 16 for clearance over the head of a stop 35 inward of the upper end of plate 10. This slot 26 also provides an opening in the recess 22 so that the head of an upper adjustment screw in opening 23 is accessible when the carriage is in the top position. When the carriage is in the top position shown in FIGS. 1 and 2 the lower end of slot 26 engages with stop 35 projecting from plate 10 to prevent further upward movement of the carriage 16.

The stay operates as follows:

The first few degrees of opening of a window should provide the maximum degree of friction to provide for ventilation in windy weather. Sliding shoes of known stays do not operate effectively in this respect in the first few degrees of opening and tend to become appreciably tighter as the angle of opening is increased. The "four arm" stay principle of the present stay provides its maximum friction in these first few degrees. Accordingly in the present invention a normal stay having selective degrees of opening between closed and the first open position is provided which thus allows for the required amount of ventilation.

When the window has opened out to the first open position the catches 25 (there being a stay for each side of the window) are released and the sash can be swung quite effortlessly to the second open position. This is due to the minimal friction level employed with the sliding plastics carriage and also due to a counterbalancing effect provided by the long lower arms 12. The tops of the long lower arms 12 terminate at bearings 14 at the lower ends of the sash plates 11 at a location as close as practicable to the center of the sash stile. This has the effect of counterbalancing the sash weight so that the various glass weights from 10 to 50 kg per square meter have little effect on the operation of the window.

When fully opened to approximately 125° the sash is semi-reversed and it is a safe and comparatively easy matter to clean the outside of the glass from inside the building. In this position the head of the sash comes down to within approximately 250mm of the window sill, so there is no risk of the window cleaner falling through this opening.

There is a substantial friction differential between the two bearings 14 and 21 on the short upper arm 15, the bearing 14 being of the normal friction type, whilst the bearing 21 is a low-friction type. This ensures that the latter moves first in the operation of the window and remains in line with the sash during sliding of the carriage to the second open position.

The vertical location of the carriage 16 on the frame plate 10 when the stay is closed determines the outward angle of the arm 15 and hence the "pull in" dimension of the stay (see FIG. 1). Accordingly, by altering the length of catch 25 the position of pivot mount 21 can be altered. This means that a standard stay can be manufactured and by employing one of a range of different length lever catches stays to suit various cavity dimensions of 28mm, 30mm, 32mm, etc. are readily obtainable. The sliding carriage 16 encompassing the "T" sectioned track provides for the mounting of the hard plastics wheels, if necessary, beneath the plate 10 away from the penetration of dirt and also allows for a wide and strong carriage. This in turn allows the lower bearing 21 of the upper arm 15 to be mounted back in the window cavity. With the minimum 8° outward angle referred to above the upper arm 15 length provides for clearance for the top flange of a sash when open, yet operates in a window cavity dimension of as little as 25mm.

The very low friction associated with the operation of the sliding carriage 16 permits a comparatively large and flexible window sash to be opened effortlessly, without the tendency to "walk" as is common with known fittings when the sliding shoes jam alternatively in operation.

The sealed bearings 14 employed for the first 30° to 50° of opening are proven to have a very long wear life. The sliding shoes employed for friction and to provide a greater degree of opening in traditional friction stays have tended to become over tight with corrosion, leading to wracking and walking of the sash and ultimately breakage of the fittings. The present invention provides an absolutely free running sliding carriage, either by employing nylon on an anodised or painted aluminium slide or, in a heavy duty version plastics wheels down the back edge of the underside of the baseplates 10 or the carriage 16, assures that the outwards forces on the carriage 16 do not lead to high friction levels or wear.

All parts of the stays are preferably of non-ferrous materials, including a black nylon sliding carriage which is largely protected from the effects of ultraviolet light.

A stay according to the foregoing meets all the requirements of present standards. The stay can be hung as shown or in a casement (projected side hung) and in the latter application is extremely useful as it provides a 125° angle of opening to allow a high degree of ventilation as is required in some countries.

The free sliding of the carriage coupled with the central cantilever location of the lower bearing 14 in sash plate 11 provides for applied operation forces of less than 80 Newtons. Finally, the friction joints 14 give a very constant resistance level for opening from the closed position to an angle of 30° to 50°.

From the foregoing it will be realized that the present invention provides a stay which has wide application and by virtue of the adjustable position of the top pivot 21 can be adapted to suit various window requirements. To further standardise on the range of stay sizes there is provided packing pieces which permit mounting of the stay in varying cavity thicknesses. The packing piece is of plastics material and has a baseplate section. The thickness varies successively between packing pieces to give different degrees of packing. Two spaced apart lugs are provided and these press fit into small openings provided either side of the mounting holes in the first and second plates. A central opening can also be provided in the baseplate to align with the hole in the mounting plate. Prior to or when installing the stay it is decided whether packing pieces are required and if so the necessary thickness is chosen. The packing is then fitted and because it remains in position the person installing the stay does not need to hold the packing in position prior to driving home the fastening screws or rivet. In the case of the sash plate the packing piece is designed to locate flush with the top of the sash.

Referring now to FIGS. 6 to 11 there is shown a second form of the invention. The stay according to these figures has the same reference numerals as corresponding parts of the stay in FIGS. 1 to 5.

According to this form the frame mounting plate 10 has an arm 10*a* pivotally hinged at 27 to its lowermost end. The first arm 12 is pivotally joined at its lower end to the free end of arm 10*a* rather than the lower end of plate 10 as shown in the previously described form. The pivot joint 27 is preferably not a friction joint.

Also shown in this form of the stay is a safety lock in the form of an arm 28 pivoted behind the top pivot 14 of the longer arm 12. This arm 28 incorporates a "T" stud (not shown) on the outer or free end and this can engage (see FIG. 6) within a "T" cross-section slot 29 in the frame plate 10. The stud can be arranged to require a specialized key/tool for disengagement for further opening of the stay, or can be simply designed to lift clear of the frameplate as required. It can if required be designed to re-engage automatically by simply incorporating a rotary spring (not shown) to align the arm with the entry to the slot 29. This safety lock arm 28 can be incorporated in the stay according to the form of FIGS. 1 to 3.

Figure 7:
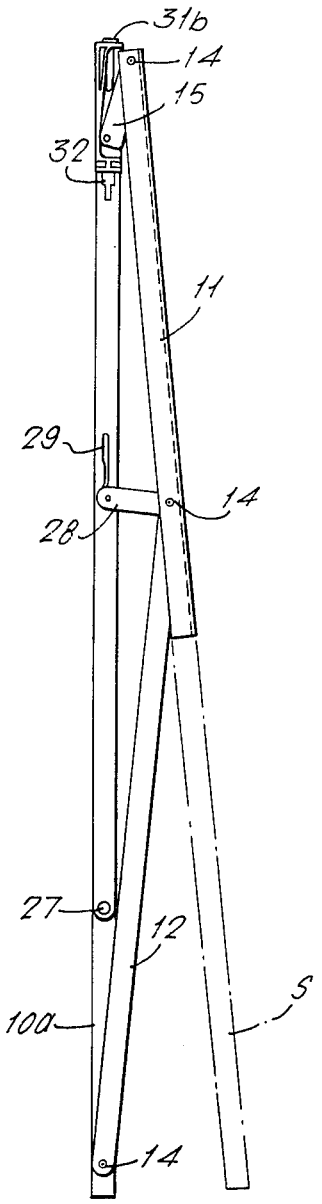
FIGS. 7–11 are elevation views similar to FIG. 6 but with the stay in different opening stages.
Figure 8:
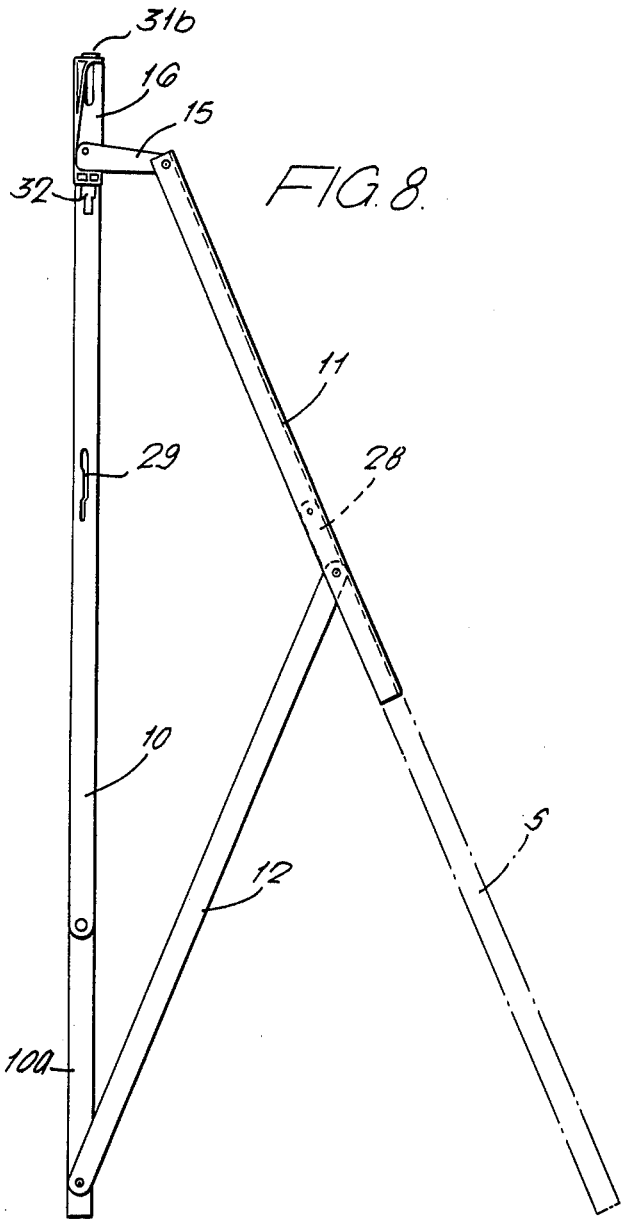
Figure 9:
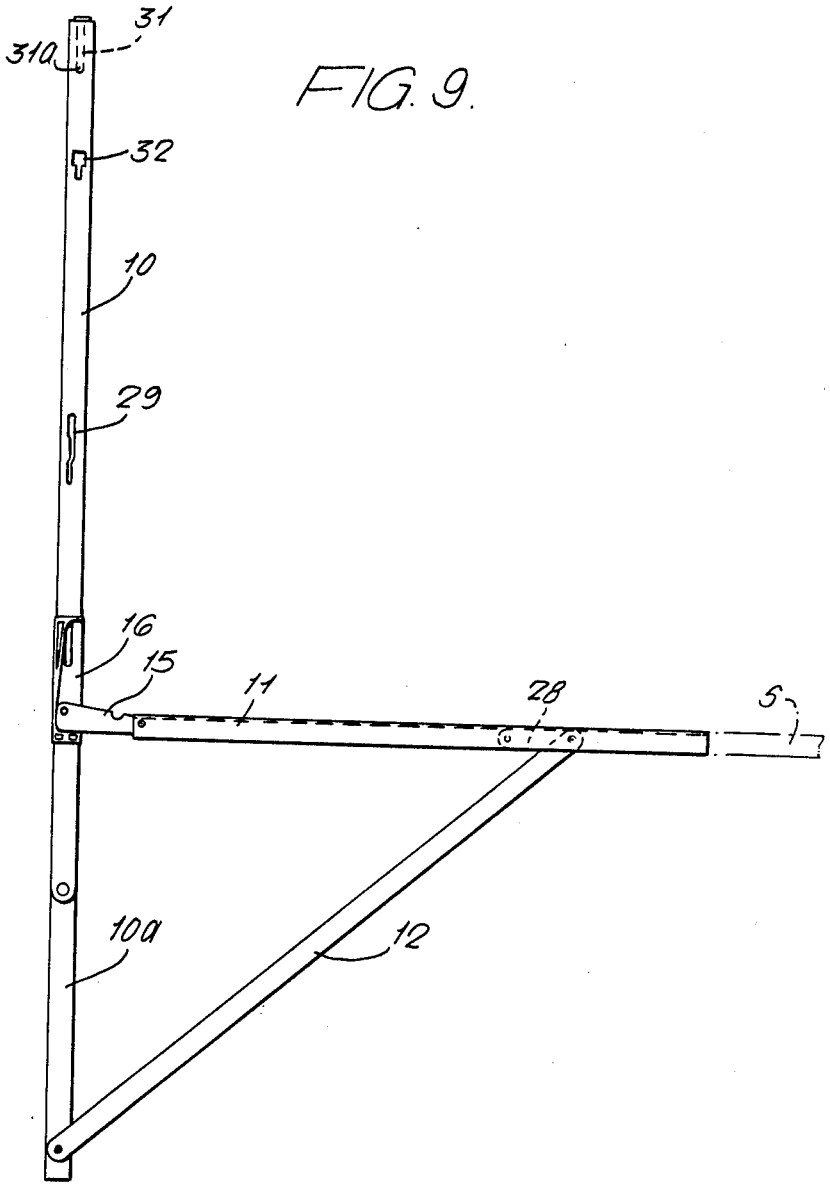
Figure 10:
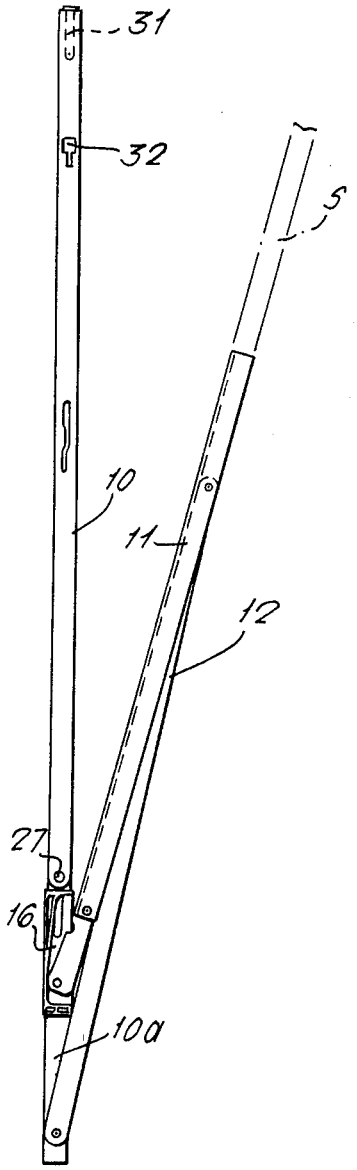
Figure 11:
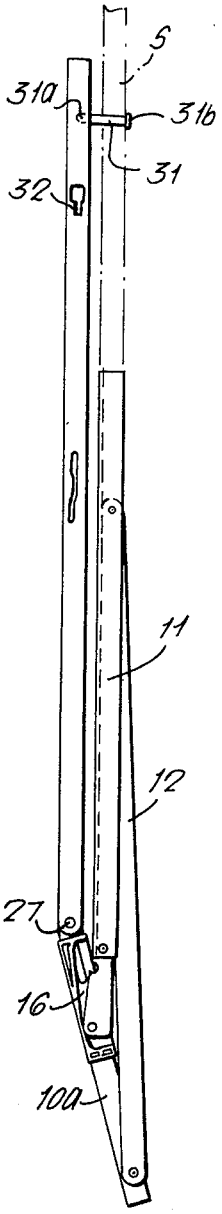

Stages of the opening of the stay are shown on FIGS. 7 to 11. In FIG. 7 the stay is only slightly open and safety lock arm 28 is in position. This allows the window to be open but not sufficient to allow children to fall out or, say, unauthorized persons to gain access. FIG. 8 shows the stay in the first open position. The carriage 16 can then be released (FIG. 9) and allowed to travel to the second open position (FIG. 10). At this point the top of the carriage 16 has passd below pivot 27. Once this extent of travel has been achieved the third arm 10*a* commences to move due to continued movement of the sash until the sash plate 11 lies substantially parallel to and adjacent the frameplate 10 (see FIG. 11). This fully open reversed position will hereinafter be referred to as the third open position.

In this form of the stay the sash can thus be fully reversed by 180° to the third open position where it is securely supported clear of the outside of the window frame, which allows, say, a window cleaner to reach around to adjacent windows and if necessary use copious quantities of water without damaging the building interior. A safety arm 31 can be concealed behind the upper portion of the frame plate 10 and being freely pivoted at 31*a* swings out when cleared by carriage 16. The arm can then lock around the perimeter of the sash S (see FIG. 11) to secure it during the cleaning operation. When closing the window carriage 16 engages with arm 30 to push it back behind plate 10 with the end of the arm providing a stop 31*b* (see FIGS. 6 to 8) for the carriage. Accordingly, the projecting stop 35 of the stay of FIGS. 1 to 5 is not required.

On the larger stay sizes where it is necessary to fully reverse large sashes to provide for safe and effective cleaning on high rise applications, it is not necessary to have the locking clip 25 at the bottom of the carriage 16 to secure the sash at intermediary positions. On these larger stays a spring biassed nylon clip 32 holds the carriage 16 in position for the normal ventilation range of the stay operation (FIGS. 7 and 8). To initiate the cleaning range the clip 32 is simply pushed in against the spring pressure so it becomes flush with surface of the plate 10 and allows carriage 16 to move downwardly. When closing the window carriage 16 rides over the spring clip 32 and is automatically locked at the top of its travel by the clip 32 once again projecting from the surface of the plate 10 after the carriage 16 has passed over.

Figure 12:
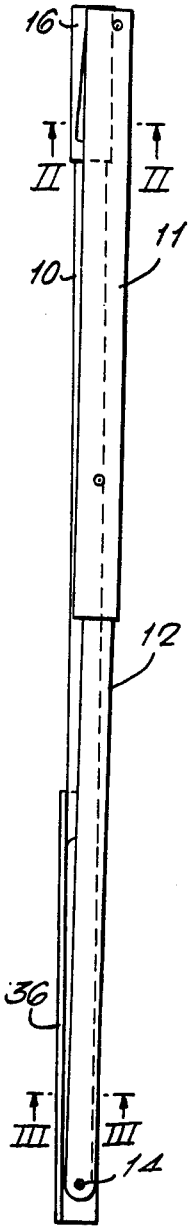
FIG. 12 is an elevation view of a third form of the invention shown in a closed position.

With large and consequently heavy sashes the stay as shown in FIGS. 6 to 11 can become heavy in operation when moving from the second to third open positions. In such applications the third form of the stay shown in FIGS. 12 to 14 can be employed. This form of the stay is much the same as the previously described second form and like parts have the same reference numerals.

The difference, however, resides in the bottom or third arm.

In this form the frameplate 10 has an extension plate 36 of L shape cross-section (FIG. 15) joined to its lower end. A pivot 37 slidably mounted in an elongate longitudinal slot 38 of plate 36 couples the third arm 10*a* to said plate 36. The free end of third arm 10*a* is joined by a friction joint 14 to the lower end of arm 12. Approximately mid length of third arm 10*a* a reversing arm 39 is pivotally mounted by one end. The other end of arm 39 is pivotally connected to the extension plate 36.

Figure 13:
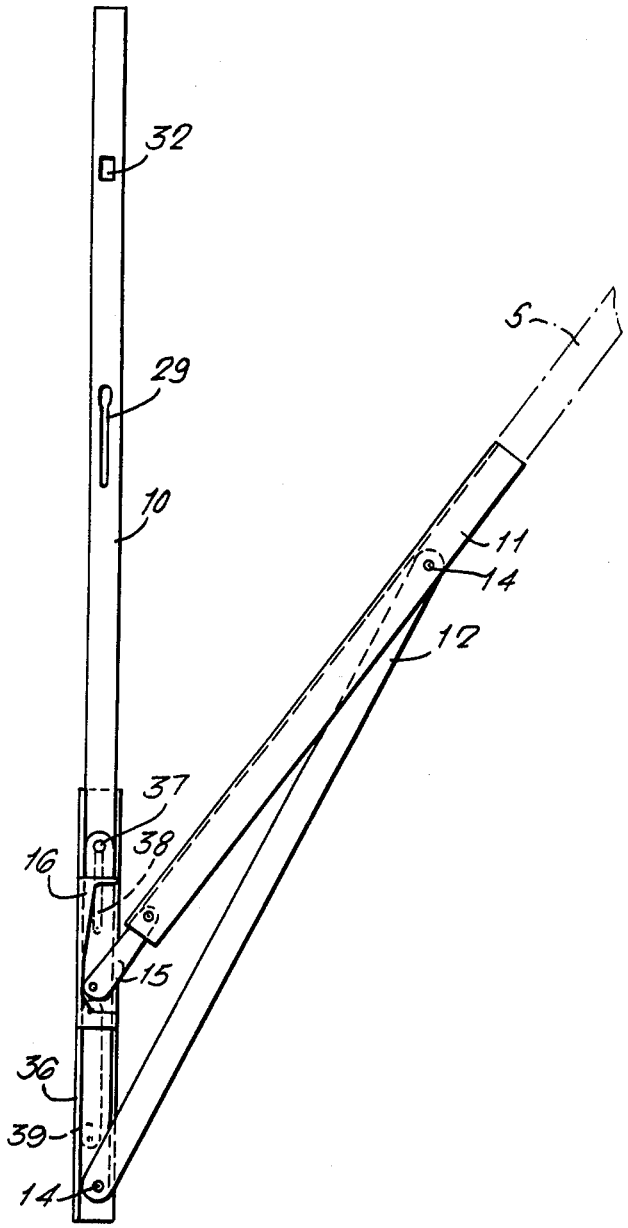
FIG. 13 is an elevation view of the stay of FIG. 12 in an open position.

Referring to FIG. 13 the second open position is shown with carriage 16 having left plate 10 passed over sliding pivot 37 and lies on arm 10*a*. At this point the reversing arm 39 commences outward movement with third arm 10*a* moving to the position shown in FIG. 14. Accordingly, the action of the reversing arm 39 together with a downward movement of arm 10*a*, by pivot 37 sliding in slot 38, effectively counterbalances the sash weight and allows the sash to move easily to the third open position where the sash is fully reversed.

Figure 14:
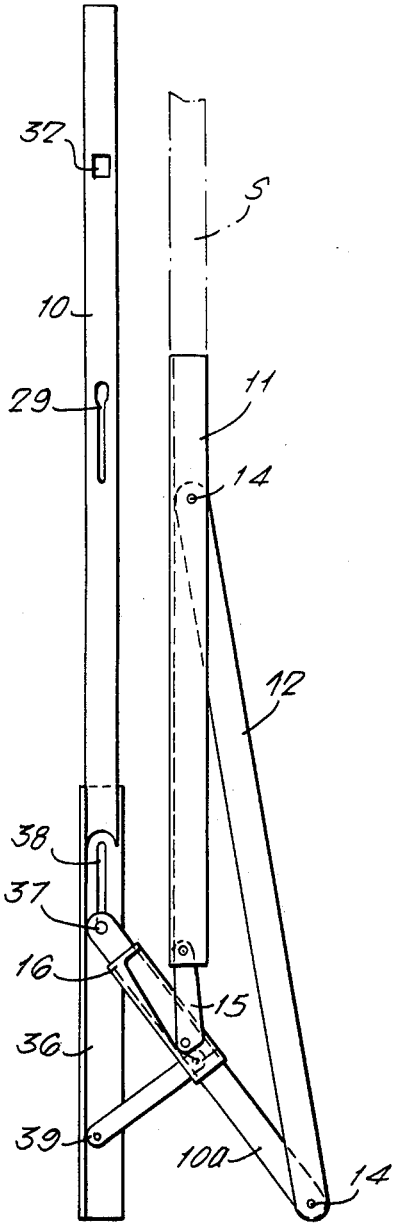
FIG. 14 is a similar view to FIG. 13 but with the stay shown in a fully open position.

Referring to FIG. 14 it will be seen that reversing arm 39 moves over center and thus when the third open position is reached the sash is effectively locked in position. To close the window the top rail of the sash (now down near the window sill) must be lifted slightly to bring the reversing arm 39 back over center whereupon the sash can be swung back again and ultimately into the closed position.

Figure 16:
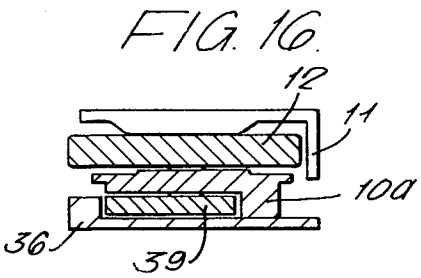
FIG. 16 is an enlarged cross-section view on line III—III of FIG. 12.
Figure 15:
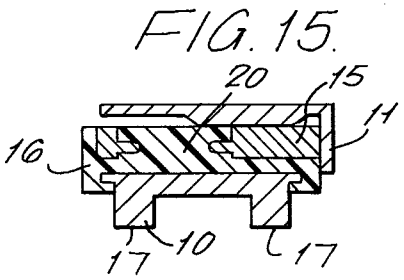
FIG. 15 is an enlarged cross-section view on line II—II of FIG. 12.

As detailed in FIG. 16 the reversing arm 39 is concealed when the stay is closed. In addition, and as shown in FIG. 15, the frame mounting plate 10 extends below the carriage 16 to provide sufficient clearance for the L shaped extension plate 36 and reversing arm 39.

Figure 18:
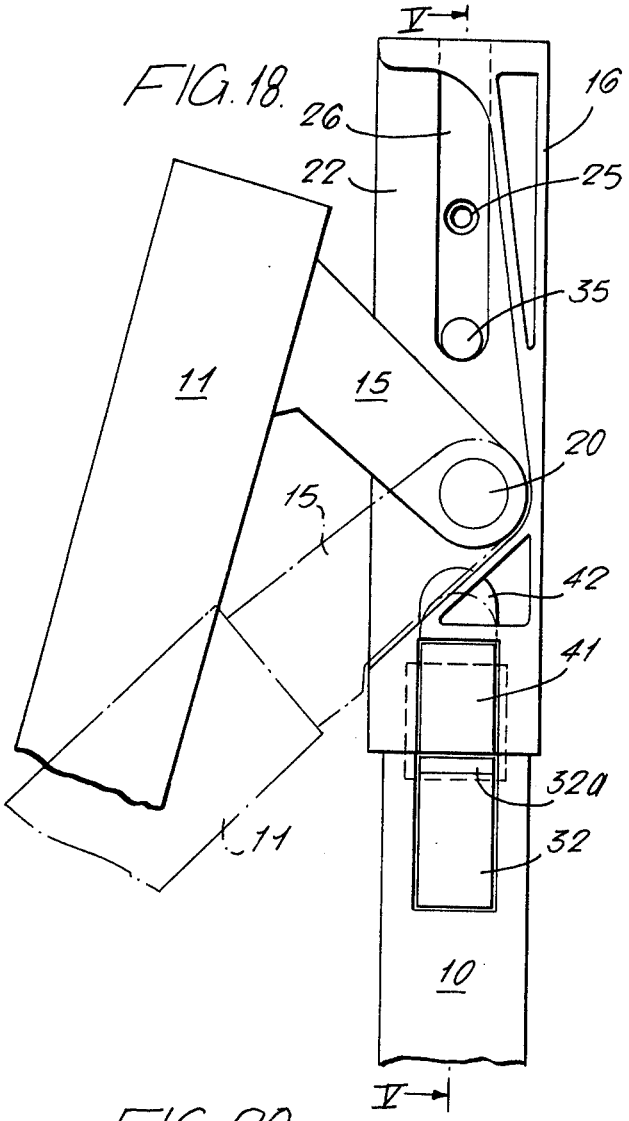
FIG. 18 is a partial elevation view of a stay similar to that shown in FIG. 1 but with a different form of carriage.
Figure 19:
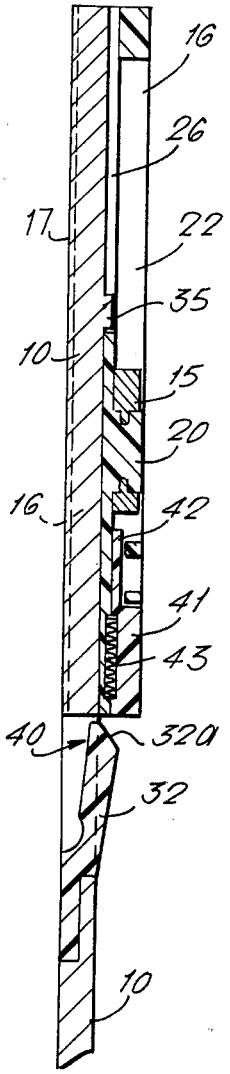
FIG. 19 is an enlarged cross-section view on line V—V of FIG. 18.

Referring to FIGS. 18 and 19 an alternative to the manual press release of the nylon clip 32 of FIGS. 6 to 11 is shown. The clip shown in these figures is designed for use on casement (projected side hung) windows where it can be a problem to reach the clip of the upper stay. The clip 32 projects above the face surface of plate 10 and can be spring mounted but as shown can be formed to be self restoring by virtue of the cross-sectional shape and restoring characteristics of the material. The upper end 40 of clip 32 is chamfered at 32*a* and engages against the lower end of the carriage 16. A spring loaded plunger 41 is retained in the carriage 16 with its upper end having rounded portion 42 which projects into recess 22. As the upper arm 15 moves down to assume the first position it engages with the projection 42 which causes plunger 41 to project from the carriage 16 and engage the chamfered end 40 of the clip 32 so pushing the clip downward to align with the surface of frameplate 10. A coil spring 43 incorporated between corresponding recesses in the plunger 41 and carriage body 16 restores it to the F rest position once carriage 26 moves over the clip 32 on its downward journey to the second open position.

In all the foregoing embodiments at least one of the pivot joints 14 has been a wear-resistant friction joint. These joints are required for friction control of the window sash when opening to the first open position, as required for ventilation. If this friction-controlled ventilation facility is not required e.g. when the stays are intended solely as a means of facilitating window cleaning, any form of pivot joint at pivots 14 would be practicable.

The stay, according to its various forms described herein, is easy to use and is designed to meet standard specifications for window stays. A window mounted by these stays can be readily reversed for cleaning as well as being opened in many different positions for regulated ventilation. The forms of the stay disclosed are by way of example and combinations of different features of the various forms together with other changes which fall within the scope of appendant claims will be evident to those skilled in the art.

What is claimed is:

1. A window stay for adjustable mounting of a window sash on a window frame comprising a first mounting plate adapted for attachment to the frame of a window, a second mounting plate or plates adapted for attachment to a sash of a window, a carriage freely slidably mounted on the first mounting plate, first and second arms each of which is pivoted at one end to the or a second mounting plate, the first arm being pivoted at its other end to the first mounting plate, the second arm, which is of shorter length than the first arm, being pivoted at its other end to the carriage, means to lock said carriage in at least a position where the pivot mount of the second arm to the carriage is at its greatest distance away from the pivot mount of said first arm to said first mounting plate, whereby with the stay in use a sash can be moved from a closed position in a window frame to an open position and thereupon opened further by releasing the carriage from its said locked position.

2. A window stay as claimed in claim 1 wherein the said other end of the first arm is pivoted to a third arm which is pivoted to one end of the first mounting plate, the third arm forming an extension of said first mounting plate whereby the carriage can slide onto said third arm.

3. A window stay as claimed in claim 1 wherein the said other end of the first arm is pivoted to a third arm which is pivotally mounted by a sliding pivot to the first mounting plate, said third arm being of such a construction that the carriage can, when said third arm is aligned with the first mounting plate, slide onto said third arm.

4. A window stay as claimed in claim 3 wherein a fourth arm is pivoted at each end to the respective first mounting plate and third arm.

5. A window stay as claimed in claim 1 wherein the carriage in said locked position is at the end of the first mounting plate which is remote from the pivot of said other end of the first arm with said first mounting plate.

6. A window stay as claimed in claim 5 wherein the locking means is provided in said first mounting plate and is released to permit movement of the carriage from said at least one position.

7. A window stay as claimed in claim 6 wherein the locking means is operated by movement of the second arm.

8. A window stay as claimed in claim 7 wherein the carriage incorporates means to limit movement of the second arm about its pivot on the carriage to between a first position where a window, when mounted by the stay, is closed and a second position where the window is open with the carriage in the said at least one position.

9. A window stay as claimed in claim 8 wherein a spring biassed plunger is incorporated in the carriage, said plunger having a portion which comes into engagement with the second arm as it nears the said second position so causing the plunger to operate the locking means and allow the carriage to move from said at least one position.

10. A window stay as claimed in claim 5 wherein the locking means is provided with said carriage and includes a cam which, when it is in the locking position, engages the first mounting plate whereby the carriage can be locked at positions along the first mounting plate from the said locked position.

11. A window stay as claimed in claim 1 wherein the first mounting plate is of shallow T cross-section shape and the carriage includes a slot of complementary cross-section which engages over the first mounting plate, the face of said first mounting plate which in use of the stay engages against the frame of the window stands proud of the carriage.

12. A window stay as claimed in claim 1 wherein at least one of the pivots of said first arm or that at the said other end of the second arm is a wear-resistant friction joint.

13. A window stay as claimed in claim 12 wherein both pivot joints of the first arm are said wear-resistant friction joints.

14. A window stay as claimed in claim 12 wherein the wear-resistant friction joints are of the type described and claimed in British patent specification No. 1,304,830.

15. A window stay as claimed in claim 2 wherein a latch arm is pivotally attached adjacent the end of the first mounting plate which is remote from the pivot joint of the first arm with the first mounting plate, said latch arm being adapted to project from the first mounting plate to engage with the second mounting plate or a sash attached thereto when said carriage is located on the third arm and said third arm has pivoted out of alignment with the first mounting plate.

16. A window stay as claimed in claim 15 wherein the latch arm locates behind the first mounting plate when said carriage is at the said at least one position and provides a stop to prevent said carriage from sliding off the first mounting plate.

17. A window stay as claimed in claim 1 wherein a series of spaced apart small diameter wheels are mounted on the first mounting plate, said wheels being positioned to engage with the carriage and assist the sliding movement thereof.

18. A window stay as claimed in claim 1 wherein at least one wheel is incorporated in the carriage and engages against a surface of the first mounting plate with which the carriage engages.

19. A window stay as claimed in claim 1 wherein the first arm is pivoted to said second mounting plate at such a position that in use it is located at or adjacent to the center of a sash stile when said stile is attached to the second mounting plate.

* * * * *